US008905865B2

(12) United States Patent
Tachibana

(10) Patent No.: US 8,905,865 B2
(45) Date of Patent: Dec. 9, 2014

(54) GOLF BALL

(75) Inventor: Kosuke Tachibana, Kobe (JP)

(73) Assignee: Dunlop Sports Co., Ltd., Kobe (JP)

( * ) Notice: Subject to any disclaimer, the term of this patent is extended or adjusted under 35 U.S.C. 154(b) by 326 days.

(21) Appl. No.: 13/593,567

(22) Filed: Aug. 24, 2012

(65) Prior Publication Data

US 2013/0053186 A1 Feb. 28, 2013

(30) Foreign Application Priority Data

Aug. 26, 2011 (JP) ..... 2011-184282

(51) Int. Cl.
*A63B 37/04* (2006.01)
*A63B 37/14* (2006.01)
*A63B 37/00* (2006.01)

(52) U.S. Cl.
CPC ..... *A63B 37/0064* (2013.01); *A63B 37/0004* (2013.01); *A63B 37/0012* (2013.01); *A63B 37/0019* (2013.01); *A63B 37/0075* (2013.01); *A63B 37/0022* (2013.01); *A63B 37/0024* (2013.01)
USPC ..... 473/377; 473/383

(58) Field of Classification Search
USPC ..... 473/351–385
See application file for complete search history.

(56) References Cited

U.S. PATENT DOCUMENTS 4,884,814 A * 12/1989 Sullivan ..... 473/372
5,427,378 A * 6/1995 Murphy ..... 473/353
5,651,741 A * 7/1997 Masutani et al. ..... 473/200
6,022,279 A * 2/2000 Yamagishi et al. ..... 473/353
6,261,193 B1 * 7/2001 Sullivan et al. ..... 473/377
6,358,160 B1 * 3/2002 Winskowicz ..... 473/378
6,435,984 B1 * 8/2002 Ohama ..... 473/377
6,554,723 B1 * 4/2003 Kametani et al. ..... 473/378
6,561,923 B1 * 5/2003 Ohama et al. ..... 473/353
6,623,379 B2 * 9/2003 Isogawa et al. ..... 473/351
7,267,622 B2 * 9/2007 Hwang ..... 473/378
7,568,986 B2 * 8/2009 Watanabe et al. ..... 473/378
7,648,428 B2 * 1/2010 Nagasawa ..... 473/378
7,648,429 B2 * 1/2010 Nagasawa ..... 473/378
7,780,550 B2 * 8/2010 Komatsu et al. ..... 473/353
7,976,412 B2 * 7/2011 Isogawa et al. ..... 473/378
8,308,587 B1 * 11/2012 Morgan ..... 473/378

(Continued)

FOREIGN PATENT DOCUMENTS

JP 05111550 A * 5/1993 ..... A63B 45/00
JP 2002224241 A * 8/2002 ..... A63B 37/00
JP 2008035951 A * 2/2008
JP 2012115503 A * 6/2012

*Primary Examiner* — Alvin Hunter
(74) *Attorney, Agent, or Firm* — Birch, Stewart, Kolasch & Birch, LLP

(57) ABSTRACT

A golf ball includes a core, a cover covering the core, and a clear layer covering the cover. The cover has dimples and a land. An xy coordinate of a hue of an outermost layer in the core excluding a colorless and transparent layer is included in any one of eight zones I to VIII. An xy coordinate of a hue of the cover is included in any one of the eight zones I to VIII which is different from and is not adjacent to the zone in which the xy coordinate of the hue of the outermost layer is included. A ratio (T1/T2) of a thickness T1 of the cover immediately below a deepest portion of each dimple and a thickness T2 of the cover immediately below the land is equal to or greater than 0.50 but equal to or less than 0.80.

6 Claims, 3 Drawing Sheets

(56) References Cited

U.S. PATENT DOCUMENTS

| | | | | |
|---|---|---|---|---|
| 8,430,768 | B2 * | 4/2013 | Komatsu et al. | 473/377 |
| 8,435,138 | B2 * | 5/2013 | Shinohara et al. | 473/378 |
| 8,460,124 | B2 * | 6/2013 | Nagasawa et al. | 473/378 |
| 8,469,837 | B2 * | 6/2013 | Komatsu et al. | 473/377 |
| 8,491,417 | B2 * | 7/2013 | Isogawa et al. | 473/378 |
| 8,491,418 | B2 * | 7/2013 | Morgan | 473/378 |
| 8,568,252 | B2 * | 10/2013 | Morgan | 473/378 |
| 8,622,851 | B2 * | 1/2014 | Komatsu et al. | 473/378 |
| 8,651,977 | B2 * | 2/2014 | Isogawa et al. | 473/378 |
| 8,678,952 | B2 * | 3/2014 | Shinohara et al. | 473/377 |
| 8,727,913 | B2 * | 5/2014 | Morgan | 473/378 |
| 8,740,727 | B2 * | 6/2014 | Nagasawa et al. | 473/378 |
| 8,801,545 | B2 * | 8/2014 | Nagasawa et al. | 473/378 |
| 2007/0135234 | A1 | 6/2007 | Nagasawa | |
| 2009/0054176 | A1 * | 2/2009 | Isogawa et al. | 473/378 |
| 2010/0261550 | A1 | 10/2010 | Nagasawa et al. | |
| 2012/0015763 | A1 * | 1/2012 | Isogawa et al. | 473/385 |

* cited by examiner

GOLF BALL

This application claims priority on Patent Application No. 2011-184282 filed in JAPAN on Aug. 26, 2011. The entire contents of this Japanese Patent Application are hereby incorporated by reference.

BACKGROUND OF THE INVENTION

1. Field of the Invention

The present invention relates to golf balls.

Specifically, the present invention relates to colored golf balls.

2. Description of the Related Art

A golf ball includes a core and a cover. A general golf ball is colored in white. The coloring is achieved by dispersing titanium dioxide in the cover. The hiding power of titanium dioxide is high. The color of the core is hidden by titanium dioxide. The coloring may be achieved by dispersing a white pigment in a paint layer.

Most golf balls are white. Thus, a golf player may falsely recognize a ball of another player as an own ball. A golf player who has hit a ball of another player is penalized.

A mark is printed on a golf ball. The mark includes a brand name and a ball number. A golf player can distinguish an own ball from a ball of another player by a brand name. A golf player can distinguish an own ball from a ball of another player also by a ball number. A golf player approaches a ball and distinguishes the ball on the basis of a mark. Distinction based on a mark is difficult from a long distance.

JP10-155937 (U.S. Pat. No. 6,022,279) discloses a golf ball having a colored cover. The golf ball is referred to as "color ball". In the color ball, a large amount of a pigment is dispersed in the cover. The color ball can easily be distinguished from a white ball.

JP2007-160087 (US2007/0135234) discloses a golf ball having a cover containing a light-collecting dye. The golf ball has excellent visibility.

JP2009-45347 (US2009/0054176) discloses a golf ball in which a cover is colored and a paint layer contains a polarizing material. The golf ball exhibits an appearance having a polarization property. The golf ball can easily be distinguished from a white ball.

JP2010-246642 (US2010/0261550) discloses a golf ball in which a cover contains a fluorescent pigment and a mid layer also contains a fluorescent pigment. The cover exhibits the same type of a hue as that of the hue of the mid layer.

In recent years, color balls have been popularized. There have been many cases where a plurality of golf players in one party use color balls. Meanwhile, when the hue of a golf ball of one golf player is the same as the hue of a golf ball of another golf player, the one golf player cannot distinguish the own golf ball from the golf ball of the other golf player. Thus, the one golf player needs to use a golf ball whose hue is different from the hue of the golf ball of the other golf player. Golf players desire golf balls having excellent distinguishability. An object of the present invention is to provide a golf ball having excellent distinguishability.

SUMMARY OF THE INVENTION

A golf ball according to the present invention comprises a core and a cover covering the core. A surface of the cover has a large number of dimples and a land that is a portion other than the dimples. When there are assumed:

(1) an xy plane in which an x axis and a y axis indicate indexes a* and b*, respectively, in a CIELAB color system;

(2) a circle that is present on the xy plane, has a center at an origin of the xy plane, and has a radius of 15;

(3) four straight lines that are present on the xy plane and pass through the origin and whose intersection angles with adjacent straight lines are 45'; and (4) eight zones that are present on the xy plane and are located outside the circle and each of which is sandwiched between two adjacent straight lines, an xy coordinate of a hue of an outermost layer in the core excluding a colorless and transparent layer is included in any one of the eight zones. An xy coordinate of a hue of the cover is included in a zone that is different from the zone in which the hue of the outermost layer is included and that is different from a zone adjacent to the zone in which the hue of the outermost layer is included. A ratio (T1/T2) of a thickness T1 of the cover immediately below a deepest portion of each dimple and a thickness T2 of the cover immediately below the land is equal to or greater than 0.50 but equal to or less than 0.80.

In the golf ball according to the present invention, the hue of each dimple and the hue of the land are different from each other. The golf ball has excellent distinguishability.

The cover can be formed from a resin composition that includes a base resin and a pigment and/or a dye. Preferably, a total amount of the pigment and the dye is equal to or greater than 0.5 parts by weight but equal to or less than 3.0 parts by weight per 100 parts by weight of the base resin.

The cover can be formed from a resin composition that includes a base resin and titanium dioxide. Preferably, an amount of the titanium dioxide is equal to or greater than 0.01 parts by weight but equal to or less than 0.1 parts by weight per 100 parts by weight of the base resin.

The golf ball may comprise a clear layer covering the cover. Preferably, the clear layer includes a large number of polarizing particles dispersed in a matrix resin.

DESCRIPTION OF THE PREFERRED EMBODIMENTS

The following will describe in detail the present invention based on preferred embodiments with reference to the accompanying drawings.

Figure 1:
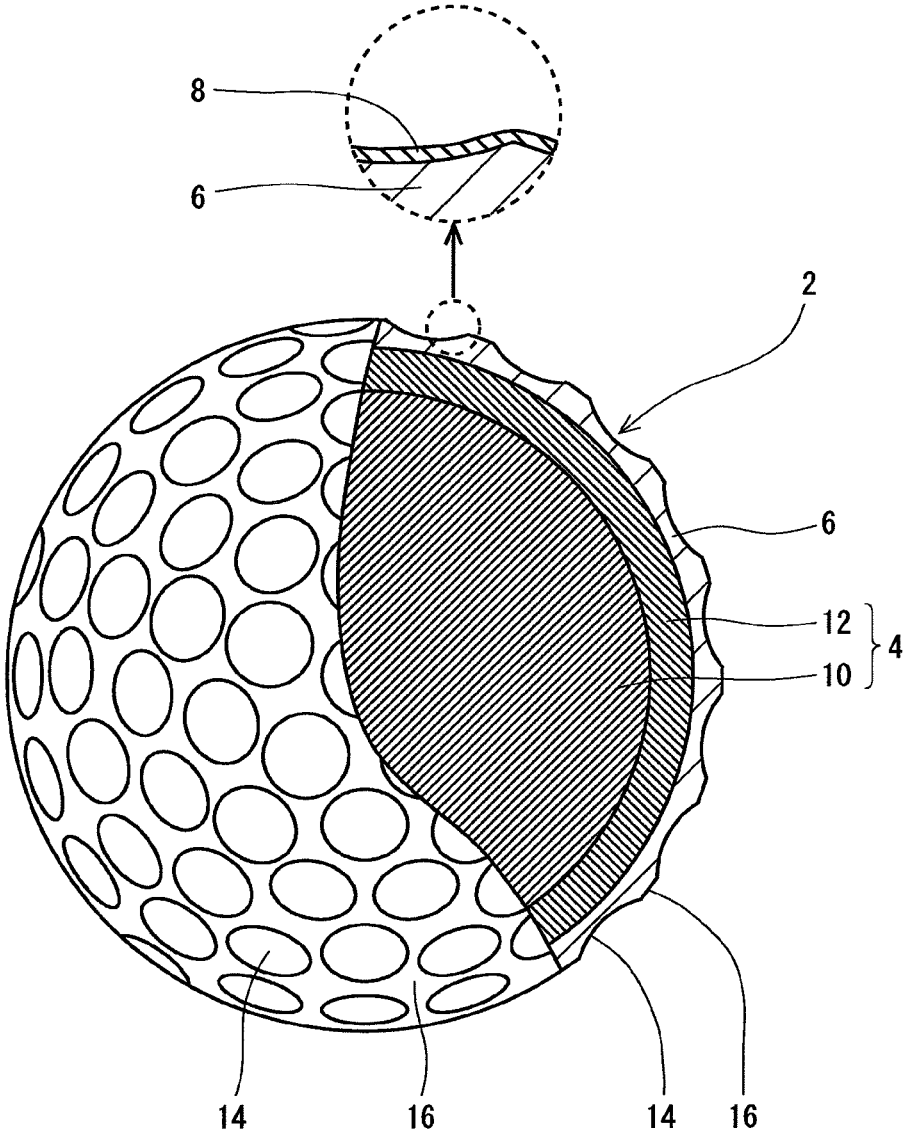
FIG. 1 is a cross-sectional view of a golf ball according to one embodiment of the present invention.
Figure 2:
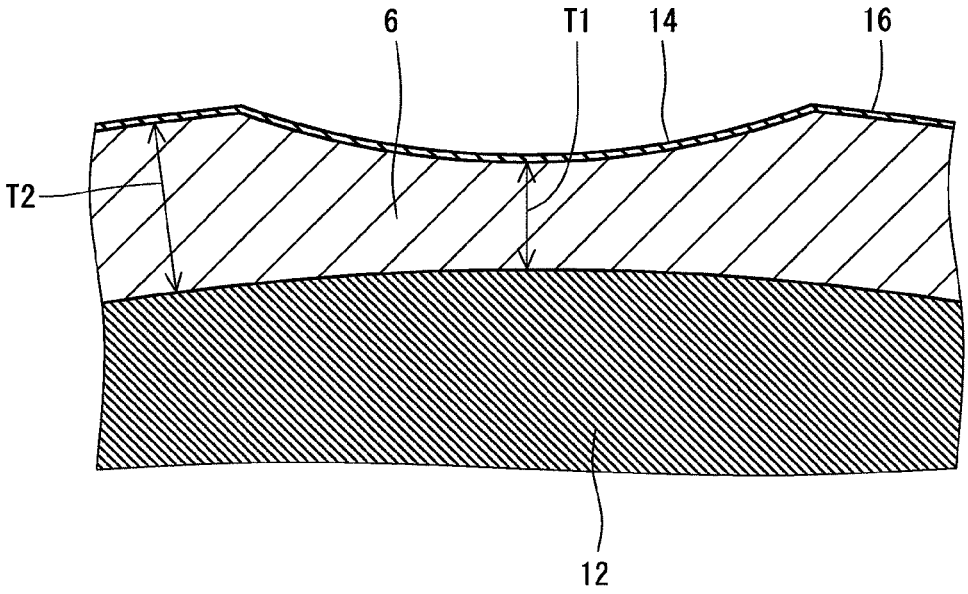
FIG. 2 is a partially enlarged cross-sectional view of the golf ball in FIG. 1.

A golf ball 2 shown in FIGS. 1 and 2 includes a spherical core 4, a cover 6 positioned outside the core 4, and a clear layer 8 positioned outside the cover 6. The core 4 includes a spherical center 10 and a mid layer 12 positioned outside the center 10. The mid layer 12 is an outermost layer in the core 4. On the surface of the cover 6, a large number of dimples 14 are formed. Of the surface of the cover 6, a part other than the dimples 14 is a land 16.

The golf ball 2 preferably has a diameter of 40 mm or greater but 45 mm or less. From the standpoint of conformity to the rules established by the United States Golf Association (USGA), the diameter is particularly preferably equal to or greater than 42.67 mm. In light of suppression of air resistance, the diameter is more preferably equal to or less than 44 mm and particularly preferably equal to or less than 42.80 mm. The golf ball 2 preferably has a weight of 40 g or greater but 50 g or less. In light of attainment of great inertia, the weight is more preferably equal to or greater than 44 g and particularly preferably equal to or greater than 45.00 g. From the standpoint of conformity to the rules established by the USGA, the weight is particularly preferably equal to or less than 45.93 g.

The center 10 is formed by crosslinking a rubber composition. Examples of base rubbers for use in the rubber composition include polybutadienes, polyisoprenes, styrene-butadiene copolymers, ethylene-propylene-diene copolymers, and natural rubbers. Two or more rubbers may be used in combination. In light of resilience performance, polybutadienes are preferred, and high-cis polybutadienes are particularly preferred.

In order to crosslink the center 10, a co-crosslinking agent is suitably used. Examples of preferable co-crosslinking agents in light of resilience performance include zinc acrylate, magnesium acrylate, zinc methacrylate, and magnesium methacrylate. Preferably, the rubber composition includes an organic peroxide together with a co-crosslinking agent. Examples of preferable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide.

The rubber composition of the center 10 may include a coloring agent. When the mid layer 12 and the cover 6 are transparent, the hue of the center 10 influences the hue of the golf ball 2. Examples of coloring agents include dyes and pigments. When the center 10 is colored in white, the rubber composition may include titanium dioxide.

According to need, various additives such as a filler, sulfur, a vulcanization accelerator, a sulfur compound, an anti-aging agent, a plasticizer, a dispersant, and the like are included in the rubber composition of the center 10 in an adequate amount. Synthetic resin powder or crosslinked rubber powder may also be included in the rubber composition.

The center 10 has a diameter of preferably 30.0 mm or greater and particularly preferably 38.0 mm or greater. The diameter of the center 10 is preferably equal to or less than 42.0 mm and particularly preferably equal to or less than 41.5 mm. The center 10 may be composed of two or more layers. The center 10 may have a rib on the surface thereof. The center 10 may be hollow.

The mid layer 12 is formed from a resin composition. A suitable polymer for the resin composition is an ionomer resin. Examples of preferable ionomer resins include binary copolymers formed with an α-olefin and an α,β-unsaturated carboxylic acid having 3 to 8 carbon atoms. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. For the binary copolymers and ternary copolymers, preferable α-olefins are ethylene and propylene, while preferable α,β-unsaturated carboxylic acids are acrylic acid and methacrylic acid. In the binary copolymers and ternary copolymers, some of the carboxyl groups are neutralized with metal ions. Examples of metal ions for use in neutralization include sodium ion, potassium ion, lithium ion, zinc ion, calcium ion, magnesium ion, aluminum ion, and neodymium ion.

Instead of an ionomer resin, other polymers may be used for the mid layer 12. Examples of the other polymers include polystyrenes, polyamides, polyesters, polyolefins, and polyurethanes. Two or more polymers may be used in combination.

The resin composition of the mid layer 12 includes a coloring agent. As the coloring agent, a dye and a pigment can be used. By the coloring agent, the mid layer 12 can be colored in orange, yellow, yellowish green, blue, pink, or the like.

Examples of coloring agents used for coloring in orange include trade names "GPX17", "GPL15", "ZQ-14", and "ZQ-17" manufactured by DayGlo Color Corp.

Examples of coloring agents used for coloring in yellow include trade names "ZQ-17" and "GPX17" manufactured by DayGlo Color Corp. and trade name "PE-D 07E 502 Yellow" manufactured by Dainichiseika Color & Chemicals Mfg. Co., Ltd.

Examples of coloring agents used for coloring in yellowish green include trade names "Yellow FL7G" and "Turq. Blue G" manufactured by Sumika Chemtex Co., Ltd.

Examples of coloring agents used for coloring in blue include trade names "PE-D 10G 765", "PE-D 06G 177 Blue", and "PE-D 06G 178 Blue" manufactured by Dainichiseika Color & Chemicals Mfg. Co., Ltd.

Examples of coloring agents used for coloring in pink include trade name "GPL11" manufactured by DayGlo Color Corp. and trade name "PE-D 06C 579 Pink" manufactured by Dainichiseika Color & Chemicals Mfg. Co., Ltd.

The mid layer 12 may be transparent or non-transparent. By the non-transparent mid layer 12, the hue of the center 10 is hidden. When the mid layer 12 is transparent, the center 10 influences the hue of the sphere that consists of the center 10 and the mid layer 12. When the mid layer 12 is transparent, the hue of the center 10 is preferably white. When the mid layer 12 includes an opacifying agent such as titanium dioxide, non-transparency of the mid layer 12 can be achieved. The mid layer 12 that does not include an opacifying agent at all or includes an opacifying agent in a small amount is transparent. In the present invention, the term "transparent" is a concept including so-called "semi-transparent".

The mid layer 12 may be colorless and transparent. The mid layer 12 that is colorless and transparent includes neither a coloring agent nor an opacifying agent. When the mid layer 12 is colorless and transparent, the center 10 is an "outermost layer in the core 4 excluding the colorless and transparent layer."

The mid layer 12 has a thickness of preferably 0.2 mm or greater and particularly preferably 0.3 mm or greater. The thickness of the mid layer 12 is preferably equal to or less than 2.5 mm and particularly preferably equal to or less than 2.2 mm. The mid layer 12 has a specific gravity of preferably 0.90 or greater and particularly preferably 0.95 or greater. The specific gravity of the mid layer 12 is preferably equal to or less than 1.10 and particularly preferably equal to or less than 1.05.

The cover 6 is formed from a resin composition. The base polymer of the resin composition is a polyurethane. Thermoplastic polyurethanes and thermosetting polyurethanes can be used. In light of productivity, thermoplastic polyurethanes are preferred. A thermoplastic polyurethane includes a polyurethane component as a hard segment, and a polyester component or a polyether component as a soft segment.

Examples of a curing agent for the polyurethane component include alicyclic diisocyanates, aromatic diisocyanates, and aliphatic diisocyanates. Alicyclic diisocyanates are particularly preferred. Since an alicyclic diisocyanate does not have any double bond in the main chain, the alicyclic diisocyanate suppresses yellowing of the cover 6. Examples of alicyclic diisocyanates include 4,4'-dicyclohexylmethane diisocyanate ($H_{12}MDI$), 1,3-bis(isocyanatomethyl)cyclohexane ($H_6XDI$), isophorone diisocyanate (IPDI), and trans-1,4-cyclohexane diisocyanate (CHDI). In light of versatility and processability, $H_{12}MDI$ is preferred.

Instead of a polyurethane, other polymers may be used for the cover 6. Examples of the other polymers include ionomer resins, polystyrenes, polyamides, polyesters, and polyolefins. Two or more polymers may be used in combination.

The resin composition of the cover 6 includes a coloring agent. As the coloring agent, a dye and a pigment can be used. By the coloring agent, the cover 6 can be colored in orange, yellow, yellowish green, blue, pink, or the like. The coloring agents described for the mid layer 12 can also be used for the cover 6.

The cover 6 is transparent. The amount of an opacifying agent such as titanium dioxide in the cover 6 is small. The cover 6 may not include an opacifying agent at all. Since the cover 6 is transparent, the mid layer 12 influences the hue of the golf ball 2.

As described above, the golf ball 2 has the dimples 14. In FIG. 2, what is indicated by a reference sign T1 is the thickness of the cover 6 immediately below the deepest portion of the dimple 14, and what is indicated by a reference sign T2 is the thickness of the cover 6 immediately below the land 16. The thickness T1 is smaller than the thickness T2.

Since the thickness T1 is small, the hue of each dimple 14 of the golf ball 2 is strongly influenced by the hue of the mid layer 12. When the thickness T2 is large, the hue of the land 16 of the golf ball 2 is not much influenced by the hue of the mid layer 12. When the hue of the cover 6 and the hue of the mid layer 12 are different from each other, the hue of each dimple 14 and the hue of the land 16 are different from each other in the golf ball 2.

Figure 3:
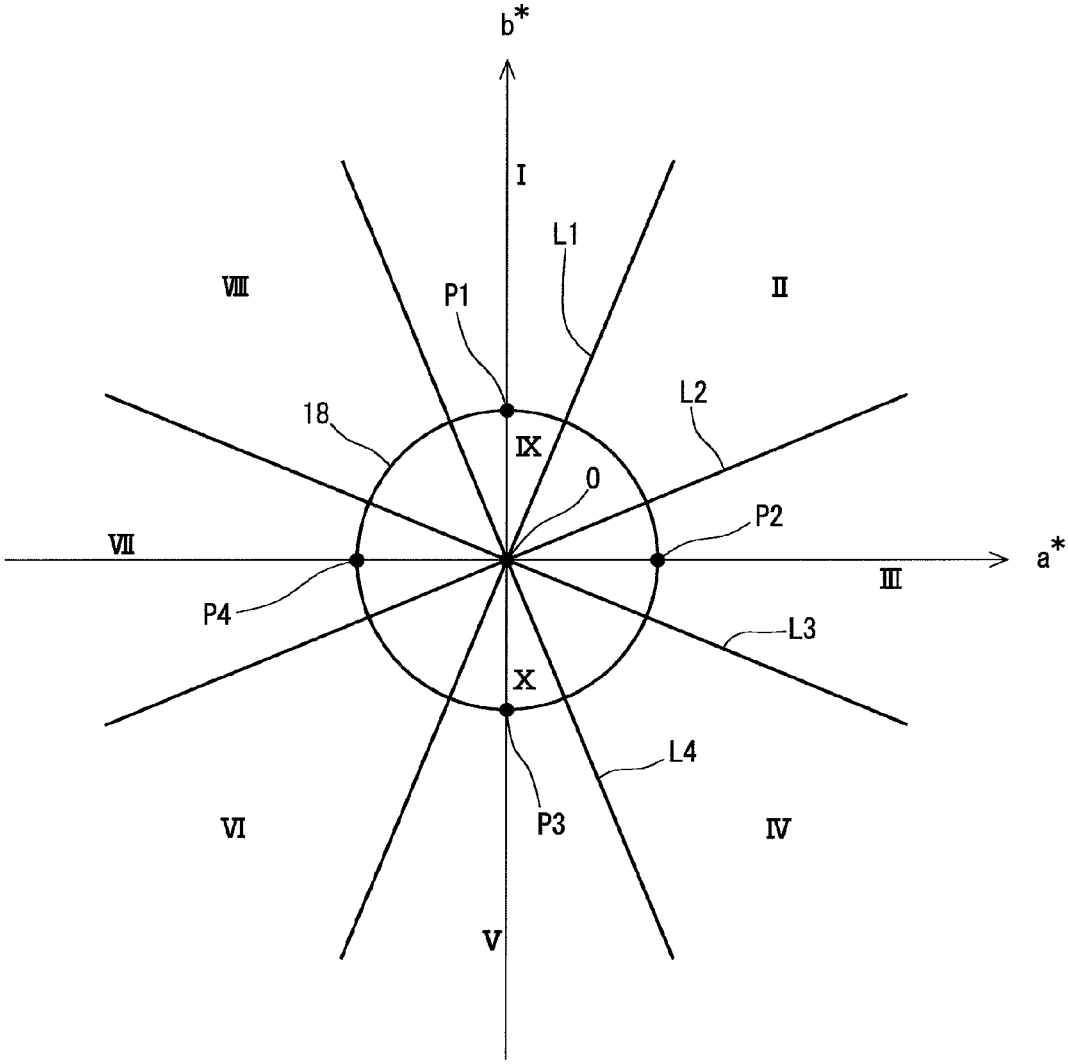
FIG. 3 is a chart for explaining zones for hues of a mid layer and a cover of the golf ball in FIG. 1.

In a chart shown in FIG. 3, the x axis (horizontal axis) and the y axis (vertical axis) indicate indexes a* and b*, respectively, in the CIELAB color system. The indexes a* and b* are calculated by the following mathematical formulas.

$$a^*=500((X/Xn)^{1/3}-(Y/Yn)^{1/3})$$

$$b^*=200((Y/Yn)^{1/3}-(Z/Zn)^{1/3})$$

In these mathematical formulas, X, Y and Z are tristimulus values in an XYZ color system, and Xn, Yn and Zn are tristimulus values of a perfect reflecting diffuser. The CIELAB color system is a standard specified by the International Commission on Illumination (CIE) in 1976. In Japan, the CIELAB color system is used in "JIS Z 8729".

a* and b* are indexes related to hue and saturation. For a*, a negative value indicates green, and a positive value indicates red. For b*, a negative value indicates blue, and a positive value indicates yellow.

In FIG. 3, what is indicated by a reference sign 18 is a circle that is present on an xy plane, has a center at an origin O of the xy plane, and has a radius of 15. The coordinate of the origin O is (0,0). Points P1 and P3 are the intersection points between the circle 18 and the y axis. The coordinate of the point P1 is (0,15), and the coordinate of the point P3 is (0,−15). The points P2 and P4 are the intersection points between the circle 18 and the x axis. The coordinate of the point P2 is (15,0), and the coordinate of the point P4 is (−15,0). The inside of the circle 18 is a zone in which saturations are less than 15.

In FIG. 3, what are indicated by reference signs L1, L2, L3, and L4 are straight lines that are present on the xy plane and pass through the origin O. The straight line L1 intersects the straight line L2 at the origin O. The intersection angle between the straight line L1 and the straight line L2 is 45°. The straight line L2 intersects the straight line L3 at the origin O. The intersection angle between the straight line L2 and the straight line L3 is 45°. The straight line L3 intersects the straight line L4 at the origin O. The intersection angle between the straight line L3 and the straight line L4 is 45°. The straight line L4 intersects the straight line L1 at the origin O. The intersection angle between the straight line L4 and the straight line L1 is 45°.

In FIG. 3, zones I to VIII are shown. The zones I to VIII are located outside the circle 18. In other words, the zones I to VIII are zones in which saturations exceed 15. The zone I is sandwiched between the straight line L4 and the straight line L1. The zone II is sandwiched between the straight line L1 and the straight line L2. The zone III is sandwiched between the straight line L2 and the straight line L3. The zone IV is sandwiched between the straight line L3 and the straight line L4. The zone V is sandwiched between the straight line L4 and the straight line L1. The zone VI is sandwiched between the straight line L1 and the straight line L2. The zone VII is sandwiched between the straight line L2 and the straight line L3. The zone VIII is sandwiched between the straight line L3 and the straight line L4.

Where a line extending from the origin O toward the positive side of the y axis is set as a reference and the clockwise direction is regarded as a forward rotational direction, the angle range of each zone is as follows.

Zone I: equal to or greater than −22.5° and less than 22.5°

Zone II: equal to or greater than 22.5° and less than 67.5°

Zone III: equal to or greater than 67.5° and less than 112.5°

Zone IV: equal to or greater than 112.5° and less than 157.5°

Zone V: equal to or greater than 157.5° and less than 202.5°

Zone VI: equal to or greater than 202.5° and less than 247.5°

Zone VII: equal to or greater than 247.5° and less than 292.5°

Zone VIII: equal to or greater than 292.5° and less than 337.5°

The zone I is adjacent to the zone VIII. The zone II is adjacent to the zone I. The zone III is adjacent to the zone II. The zone IV is adjacent to the zone III. The zone V is adjacent to the zone IV. The zone VI is adjacent to the zone V. The zone VII is adjacent to the zone VI. The zone VIII is adjacent to the zone VII.

The zone IX is located inside the circle 18 and sandwiched between the straight line L4 and the straight line L1. The zone IX is located on the inner side of the zone I. The zone X is located inside the circle 18 and sandwiched between the straight line L4 and the straight line L1. The zone X is located on the inner side of the zone V. The angle ranges of the zone IX and the zone X are as follows.

Zone IX: equal to or greater than −22.5° and less than 22.5°

Zone X: equal to or greater than 157.5° and less than 202.5°

When the mid layer 12 is colored, the xy coordinate of the hue of the mid layer 12 belongs to any one of the eight zones I to VIII. In other words, the xy coordinate of the hue of the mid layer 12 is located outside the circle 18. For the hue of the mid layer 12, the hue of a slab that is formed from the resin composition of the mid layer 12 and has a thickness of 2.0 mm is measured. At the measurement, the slab is placed on a white plate. The measurement is conducted by using the spectrophotometer "CM-3500d" manufactured by Konica Minolta Sensing, Inc. A light receiver is applied to the surface of the slab to conduct the measurement. As a light source, "a standard light $D_{65}$" is used. The color temperature of the light source is 6504 k. As a spectral sensitivity, "a view angle of 2°" is used. As a hole diameter, 3 mm is used.

When the mid layer 12 is colorless and transparent, the xy coordinate of the hue of the center 10 belongs to any one of the eight zones I to VIII. The light receiver of the spectrophotometer is applied to the surface of the center 10 to measure the hue of the center 10.

The xy coordinate of the hue of the cover 6 belongs to any one of the eight zones I to VIII. In other words, the xy coordinate of the hue of the cover 6 is located outside the circle 18. For the hue of the cover 6, the hue of a slab that is formed from the resin composition of the cover 6 and has a thickness of 2.0 mm is measured. The hue of the cover 6 is measured by the same method as that for the hue of the mid layer 12.

When the mid layer 12 is colored, a zone to which the xy coordinate of the hue of the cover 6 belongs is different from a zone to which the xy coordinate of the hue of the mid layer 12 belongs. The zone to which the xy coordinate of the hue of the cover 6 belongs is not adjacent to the zone to which the xy coordinate of the hue of the mid layer 12 belongs. In other words, the hue of the cover 6 and the hue of the mid layer 12 are greatly different from each other. The hue of each dimple 14 is strongly influenced by the hue of the mid layer 12. The hue of the land 16 is strongly influenced by the hue of the cover 6. In the golf ball 2, the hue of each dimple 14 and the hue of the land 16 are greatly different from each other. The golf ball 2 exhibits a characteristic appearance. The appearance is novel. The golf ball 2 is easily distinguished from another golf ball.

Preferable combinations of zones for the mid layer 12 and the cover 6 are as follows.

| Mid layer | Cover |
|---|---|
| Zone I | Zone III |
| Zone I | Zone IV |
| Zone I | Zone V |
| Zone I | Zone VI |
| Zone I | Zone VII |
| Zone II | Zone IV |
| Zone II | Zone V |
| Zone II | Zone VI |
| Zone II | Zone VII |
| Zone II | Zone VIII |
| Zone III | Zone I |
| Zone III | Zone V |
| Zone III | Zone VI |
| Zone III | Zone VII |
| Zone III | Zone VIII |
| Zone IV | Zone I |
| Zone IV | Zone II |
| Zone IV | Zone VI |
| Zone IV | Zone VII |
| Zone IV | Zone VIII |
| Zone V | Zone I |
| Zone V | Zone II |
| Zone V | Zone III |
| Zone V | Zone VII |
| Zone V | Zone VIII |
| Zone VI | Zone I |
| Zone VI | Zone II |
| Zone VI | Zone III |
| Zone VI | Zone IV |
| Zone VI | Zone VIII |
| Zone VII | Zone I |
| Zone VII | Zone II |
| Zone VII | Zone III |
| Zone VII | Zone IV |
| Zone VII | Zone V |
| Zone VIII | Zone II |
| Zone VIII | Zone III |
| Zone VIII | Zone IV |
| Zone VIII | Zone V |
| Zone VIII | Zone VI |

When the mid layer 12 is colorless and transparent, a zone to which the xy coordinate of the hue of the cover 6 belongs is different from a zone to which the xy coordinate of the hue of the center 10 belongs. The zone to which the xy coordinate of the hue of the cover 6 belongs is not adjacent to the zone to which the xy coordinate of the hue of the center 10 belongs. In other words, the hue of the cover 6 and the hue of the center 10 are greatly different from each other. In the golf ball 2, the hue of each dimple 14 and the hue of the land 16 are greatly different from each other. The golf ball 2 exhibits a characteristic appearance. The appearance is novel. The golf ball 2 is easily distinguished from another golf ball.

The ratio (T1/T2) of the thickness T1 of the cover 6 immediately below the deepest portion of each dimple 14 and the thickness T2 of the cover 6 immediately below the land 16 is preferably equal to or greater than 0.50 but equal to or less than 0.80. The golf ball 2 in which the ratio (T1/T2) is equal to or greater than 0.50 has excellent durability. In this respect, the ratio (T1/T2) is particularly preferably equal to or greater than 0.55. In the golf ball 2 in which the ratio (T1/T2) is equal to or less than 0.80, the hue of each dimple 14 and the hue of the land 16 can be greatly different from each other. In this respect, the ratio (T1/T2) is particularly preferably equal to or less than 0.70. From the standpoint that the hue of each dimple 14 and the hue of the land 16 can be greatly different from each other, the difference (T2−T1) between the thickness T2 and the thickness T1 is preferably equal to or greater than 0.1 mm.

In light of durability of the golf ball 2, the thickness T1 is preferably equal to or greater than 0.15 mm and particularly preferably equal to or greater than 0.20 mm. From the standpoint that the influence of the hue of the mid layer 12 on the hue of each dimple 14 is great, the thickness T1 is preferably equal to or less than 2.0 mm and particularly preferably equal to or less than 1.0 mm.

The total amount of the pigment and the dye in the resin composition of the cover 6 is preferably equal to or greater than 0.5 parts by weight but equal to or less than 3.0 parts by weight per 100 parts by weight of the base resin. In the cover 6 in which the total amount is equal to or greater than 0.5 parts by weight, the influence of the hue of the mid layer 12 on the hue of the land 16 is small. In this respect, the total amount is more preferably equal to or greater than 0.7 parts by weight and particularly preferably equal to or greater than 1.0 parts by weight per 100 parts by weight of the base resin. In the cover 6 in which the total amount is equal to or less than 3.0 parts by weight, the influence of the hue of the mid layer 12 on the hue of each dimple 14 is great. In this respect, the total amount is particularly preferably equal to or less than 2.5 parts by weight per 100 parts by weight of the base resin.

The amount of titanium dioxide in the resin composition of the cover 6 is preferably equal to or greater than 0.01 parts by weight but equal to or less than 0.1 parts by weight per 100 parts by weight of the base resin. In the cover 6 in which the amount is equal to or greater than 0.01 parts by weight, the influence of the hue of the mid layer 12 on the hue of the land 16 is small. In this respect, the amount is particularly preferably equal to or greater than 0.2 parts by weight per 100 parts by weight of the base resin. In the cover 6 in which the amount is equal to or less than 0.1 parts by weight, the influence of the hue of the mid layer 12 on the hue of each dimple 14 is great. In this respect, the amount is particularly preferably equal to or less than 0.08 parts by weight per 100 parts by weight of the base resin.

The clear layer 8 covers the cover 6. The clear layer 8 protects the cover 6. The clear layer 8 achieves excellent appearance of the golf ball 2. The clear layer 8 is formed by application of a paint. Electrostatic coating, spray gun coating, brushing, or the like can be used. Examples of a base resin of the paint include polyurethanes, epoxy resins, polyesters, acrylic resins, and cellulose resins. In light of durability of the clear layer 8, two-component curing type polyurethanes are preferred.

A two-component curing type polyurethane is obtained by a reaction of a base material and a curing agent. A two-component curing type polyurethane obtained by a reaction of: a base material containing a polyol component; and a curing agent containing a polyisocyanate (including a polyisocyanate derivative), is preferred.

The clear layer 8 includes a large number of polarizing particles dispersed in a matrix resin. Each of the polarizing particles is preferably composed of a core and a coat layer. A specific example of the core is mica. A specific example of the material of the coat layer is titanium oxide. A portion of light entering the clear layer 8 reflects off the coat layer. A portion of light entering the clear layer 8 passes through the coat layer and reflects off the core. The light having reflected off the coat layer interferes with the light having reflected off the core. By this interference, a photoluminescent property is provided to the golf ball 2. The appearance of the golf ball 2 having a photoluminescent property is different from that of a conventional golf ball. The golf ball 2 has excellent visibility and distinguishability. In addition, the golf ball 2 having a photoluminescent property has an excellent sense of splendor.

The polarizing particles are in the form of flakes. The polarizing particles in the form of flakes have directivity in interferential action. The hue of each polarizing particle varies in accordance with an angle at which the polarizing particle is viewed. By dispersing the polarizing particles in the form of flakes, a polarization property is provided to the golf ball 2. The polarization property achieves excellent visibility and distinguishability of and an excellent sense of luxury of the golf ball 2.

Although not shown, the golf ball 2 may include a reinforcing layer between the core 4 and the cover 6. The reinforcing layer firmly adheres to the mid layer 12, which is the outermost layer of the core 4, and also firmly adheres to the cover 6. The reinforcing layer suppresses separation of the cover 6 from the mid layer 12. Examples of the base polymer of the reinforcing layer include two-component curing type epoxy resins and two-component curing type urethane resins.

From the standpoint that the influence of the hue of the mid layer 12 on the hue of each dimple 14 is not impaired, the hue of the reinforcing layer is preferably colorless and transparent or white and transparent. From the standpoint that the influence of the hue of the mid layer 12 on the hue of each dimple 14 is not impaired, the thickness of the reinforcing layer is preferably equal to or less than 0.05 mm and particularly preferably equal to or less than 0.01 mm.

EXAMPLES

Example 1

A rubber composition was obtained by kneading 100 parts by weight of a high-cis polybutadiene (trade name "BR-730", manufactured by JSR Corporation), 10.65 parts by weight of fin powder, 38 parts by weight of zinc diacrylate (trade name "Sanceler SR", manufactured by SANSHIN CHEMICAL INDUSTRY CO., LTD.), 8.5 parts by weight of zinc oxide (trade name "White Seal", manufactured by PT. INDO LYSAGHT), 5.0 parts by weight of titanium dioxide, 0.5 parts by weight of diphenyl disulfide, and 0.7 parts by weight of dicumyl peroxide (NOF Corporation). This rubber composition was placed into a mold including upper and lower mold halves each having a hemispherical cavity, and heated at 170° C. for 18 minutes to obtain a center with a diameter of 40.00 mm. The hue of the center was generally white.

A resin composition was obtained by kneading 50 parts by weight of an ionomer resin (trade name "Himilan 1605", manufactured by Du Pont-MITSUI POLYCHEMICALS Co., Ltd.), 50 parts by weight of another ionomer resin (trade name "Himilan AM7329", manufactured by Du Pont-MITSUI POLYCHEMICALS Co., Ltd.), 1 parts by weight of a coloring agent (the aforementioned "ZQ-17"), and 0.05 parts by weight of titanium dioxide with a twin-screw kneading extruder. The hue of the resin composition is yellow and its xy coordinate is included in the zone I. The resin composition is non-transparent. The center was covered with the resin composition by injection molding to form a mid layer with a thickness of 1.0 mm.

A paint composition (trade name "POLIN 750LE", manufactured by SHINTO PAINT CO., LTD.) including a two-component curing type epoxy resin as a base polymer was prepared. The base material liquid of this paint composition includes 30 parts by weight of a bisphenol A type solid epoxy resin and 70 parts by weight of a solvent. The curing agent liquid of this paint composition includes 40 parts by weight of a modified polyamide amine, 55 parts by weight of a solvent, and 5 parts by weight of titanium oxide. The weight ratio of the base material liquid to the curing agent liquid is 1/1. This paint composition was applied to the surface of the mid layer with a spray gun, and kept at 23° C. for 6 hours to obtain a reinforcing layer with a thickness of 0.01 mm.

A resin composition was obtained by kneading 100 parts by weight of a thermoplastic polyurethane elastomer (trade name "Elastollan XNY88A (clear)", manufactured by BASF Japan Ltd.), 1 parts by weight of a coloring agent (the aforementioned "GPL11"), and 0.05 parts by weight of titanium dioxide with a twin-screw kneading extruder. The hue of the resin composition is pink and its xy coordinate is included in the zone IV. The resin composition is transparent. Half shells were formed from this resin composition by compression molding. The sphere consisting of the center, the mid layer, and the reinforcing layer was covered with two of these half shells. The sphere and the half shells were placed into a final mold that includes upper and lower mold halves each having a hemispherical cavity and having a large number of pimples on its cavity face, and a cover was obtained by compression molding. The thickness of the cover was 0.35 mm. A large number of dimples having a shape that is the inverted shape of the pimples were formed on the cover. A clear paint including a two-component curing type polyurethane as a base material was applied to this cover to obtain a golf ball of Example 1 with a diameter of about 42.7 mm and a weight of about 45.6 g.

Examples 2 to 21 and Comparative Examples 1 to 14

Golf balls of Examples 2 to 21 and Comparative Examples 1 to 14 were obtained in the same manner as Example 1, except the specifications of the center, the mid layer, the cover, and the dimples were as shown in Tables 1 to 7 below. The composition of the center is shown in detail in Table 8 below. The composition of the mid layer is shown in detail in Tables 9 and 10 below. The composition of the cover is shown in detail in Table 11 below.

[Visibility]

A golf ball was placed on lawn. Ten golf players who were distant from the ball by 150 m evaluated visibility of the ball. The evaluation was categorized as follows on the basis of the number of golf players who determined that the ball was easily viewable.

A: 9 or more
B: 7 to 8
C: 4 to 6
D: 3 or less

The results are shown in Tables 1 to 7 below.

[Distinguishability]

Each golf ball was placed on lawn together with a conventional white golf ball. Ten golf players who were distant from the ball by 5 m evaluated whether or not it was possible to distinguish the ball from the conventional white golf ball. The evaluation was categorized as follows on the basis of the number of golf players who was able to easily distinguish the ball.

A: 9 or more
B: 7 to 8
C: 4 to 6
D: 3 or less

The results are shown in Tables 1 to 7 below.

[Novelty]

Ten golf players compared the appearance of each golf ball with a commercially-available color ball. The evaluation was categorized as follows on the basis of the number of golf players who determined that the appearance of the ball was novel.

A: 9 or more
B: 7 to 8
C: 4 to 6
D: 3 or less

The results are shown in Tables 1 to 7 below.

TABLE 1

| Results of Evaluation | | | | | | |
|---|---|---|---|---|---|---|
| | | Ex. 1 | Ex. 2 | Ex. 3 | Ex. 4 | Ex. 5 |
| Center | Color | Blue | Blue | Blue | Blue | Blue |
| | L | 38.2 | 38.2 | 38.2 | 38.2 | 38.2 |
| | a* | −13.6 | −13.6 | −13.6 | −13.6 | −13.6 |
| | b* | −10.3 | −10.3 | −10.3 | −10.3 | −10.3 |
| Mid layer | Composition | A | A | C | C | C |
| | Zone | I | I | II | II | II |
| | Color | Yellow | Yellow | Orange | Orange | Orange |
| | T/NT | NT | NT | NT | NT | NT |
| | L | 93 | 93 | 76 | 76 | 76 |
| | a* | −9 | −9 | 27 | 27 | 27 |
| | b* | 47 | 47 | 43 | 43 | 43 |
| Cover | Composition | N | O | N | O | P |
| | Zone | IV | V | IV | V | VIII |
| | Color | Pink | Blue | Pink | Blue | Green |
| | T/NT | T | T | T | T | T |
| | L | 84 | 80 | 84 | 80 | 90 |
| | a* | 19 | −5 | 19 | −5 | 50 |
| | b* | −10 | −15 | −10 | −15 | 55 |
| | T1 (mm) | 0.23 | 0.23 | 0.23 | 0.23 | 0.23 |
| | T2 (mm) | 0.35 | 0.35 | 0.35 | 0.35 | 0.35 |
| | T1/T2 | 0.66 | 0.66 | 0.66 | 0.66 | 0.66 |
| Visibility | | A | B | B | B | B |
| Distinguishability | | A | A | A | A | A |
| Novelty | | A | A | B | A | A |

T: Transparent
NT: Non-transparent

TABLE 2

| Results of Evaluation | | | | | | |
|---|---|---|---|---|---|---|
| | | Ex. 6 | Ex. 7 | Ex. 8 | Ex. 9 | Ex. 10 |
| Center | Color | Blue | Blue | Blue | Blue | Blue |
| | L | 38.2 | 38.2 | 38.2 | 38.2 | 38.2 |
| | a* | −13.6 | −13.6 | −13.6 | −13.6 | −13.6 |

TABLE 2-continued

| Results of Evaluation | | | | | | |
|---|---|---|---|---|---|---|
| | | Ex. 6 | Ex. 7 | Ex. 8 | Ex. 9 | Ex. 10 |
| | b* | −10.3 | −10.3 | −10.3 | −10.3 | −10.3 |
| Mid layer | Composition | E | E | E | G | G |
| | Zone | IV | IV | IV | V | V |
| | Color | Pink | Pink | Pink | Blue | Blue |
| | T/NT | NT | NT | NT | NT | NT |
| | L | 95 | 95 | 95 | 89 | 89 |
| | a* | 17 | 17 | 17 | −6 | −6 |
| | b* | −15 | −15 | −15 | −20 | −20 |
| Cover | Composition | K | L | P | K | L |
| | Zone | I | II | VIII | I | II |
| | Color | Yellow | Orange | Green | Yellow | Orange |
| | T/NT | T | T | T | T | T |
| | L | 60 | 73 | 90 | 60 | 73 |
| | a* | −10 | 49 | 50 | −10 | 49 |
| | b* | 30 | 81 | 55 | 30 | 81 |
| | T1 (mm) | 0.23 | 0.23 | 0.23 | 0.23 | 0.23 |
| | T2 (mm) | 0.35 | 0.35 | 0.35 | 0.35 | 0.35 |
| | T1/T2 | 0.66 | 0.66 | 0.66 | 0.66 | 0.66 |
| Visibility | | A | B | B | B | B |
| Distinguishability | | A | A | A | A | A |
| Novelty | | A | B | A | A | A |

T: Transparent
NT: Non-transparent

TABLE 3

| Results of Evaluation | | | | | | |
|---|---|---|---|---|---|---|
| | | Ex. 11 | Ex. 12 | Ex. 13 | Ex. 14 | Com. Ex. 1 |
| Center | Color | Blue | Blue | Blue | Blue | Blue |
| | L | 38.2 | 38.2 | 38.2 | 38.2 | 38.2 |
| | a* | −13.6 | −13.6 | −13.6 | −13.6 | −13.6 |
| | b* | −10.3 | −10.3 | −10.3 | −10.3 | −10.3 |
| Mid layer | Composition | G | I | I | I | A |
| | Zone | V | VIII | VIII | VIII | I |
| | Color | Blue | Green | Green | Green | Yellow |
| | T/NT | NT | NT | NT | NT | NT |
| | L | 89 | 98 | 98 | 98 | 93 |
| | a* | −6 | 53 | 53 | 53 | −9 |
| | b* | −20 | 58 | 58 | 58 | 47 |
| Cover | Composition | P | L | N | O | L |
| | Zone | VIII | II | IV | V | II |
| | Color | Green | Orange | Pink | Blue | Orange |
| | T/NT | T | T | T | T | T |
| | L | 90 | 73 | 84 | 80 | 73 |
| | a* | 50 | 49 | 19 | −5 | 49 |
| | b* | 55 | 81 | −10 | −15 | 81 |
| | T1 (mm) | 0.23 | 0.23 | 0.23 | 0.23 | 0.23 |
| | T2 (mm) | 0.35 | 0.35 | 0.35 | 0.35 | 0.35 |
| | T1/T2 | 0.66 | 0.66 | 0.66 | 0.66 | 0.66 |
| Visibility | | B | B | B | B | A |
| Distinguishability | | A | A | A | A | B |
| Novelty | | B | A | A | B | D |

T: Transparent
NT: Non-transparent

TABLE 4

| Results of Evaluation | | | | | | |
|---|---|---|---|---|---|---|
| | | Com. Ex. 2 | Com. Ex. 3 | Com. Ex. 4 | Com. Ex. 5 | Com. Ex. 6 |
| Center | Color | Blue | Blue | Blue | Blue | Blue |
| | L | 38.2 | 38.2 | 38.2 | 38.2 | 38.2 |
| | a* | −13.6 | −13.6 | −13.6 | −13.6 | −13.6 |
| | b* | −10.3 | −10.3 | −10.3 | −10.3 | −10.3 |
| Mid layer | Composition | A | C | E | G | I |
| | Zone | I | II | IV | V | VIII |

TABLE 4-continued

| Results of Evaluation | | | | | | |
|---|---|---|---|---|---|---|
| | | Com. Ex. 2 | Com. Ex. 3 | Com. Ex. 4 | Com. Ex. 5 | Com. Ex. 6 |
| | Color | Yellow | Orange | Pink | Blue | Green |
| | T/NT | NT | NT | NT | NT | NT |
| | L | 93 | 93 | 95 | 89 | 98 |
| | a* | −9 | −9 | 17 | −6 | 53 |
| | b* | 47 | 47 | −15 | −20 | 58 |
| Cover | Composition | P | K | O | N | K |
| | Zone | VIII | I | V | IV | I |
| | Color | Green | Yellow | Blue | Pink | Yellow |
| | T/NT | T | T | T | T | T |
| | L | 90 | 60 | 80 | 84 | 60 |
| | a* | 50 | −10 | −5 | 19 | −10 |
| | b* | 55 | 30 | −15 | −10 | 30 |
| | T1 (mm) | 0.23 | 0.23 | 0.23 | 0.23 | 0.23 |
| | T2 (mm) | 0.35 | 0.35 | 0.35 | 0.35 | 0.35 |
| | T1/T2 | 0.66 | 0.66 | 0.66 | 0.66 | 0.66 |
| Visibility | | B | A | B | B | B |
| Distinguishability | | A | B | B | B | A |
| Novelty | | C | D | C | C | C |

T: Transparent
NT: Non-transparent

TABLE 5

| Results of Evaluation | | | | | | |
|---|---|---|---|---|---|---|
| | | Com. Ex. 7 | Com. Ex. 8 | Com. Ex. 9 | Com. Ex. 10 | Com. Ex. 11 |
| Center | Color | Blue | Blue | Blue | Blue | Blue |
| | L | 38.2 | 38.2 | 38.2 | 38.2 | 38.2 |
| | a* | −13.6 | −13.6 | −13.6 | −13.6 | −13.6 |
| | b* | −10.3 | −10.3 | −10.3 | −10.3 | −10.3 |
| Mid layer | Composition | A | C | Q | Q | A |
| | Zone | I | II | IX | IX | I |
| | Color | Yellow | Orange | Yellow | Yellow | Yellow |
| | T/NT | NT | NT | NT | NT | NT |
| | L | 93 | 76 | 90 | 90 | 93 |
| | a* | −9 | 27 | −3 | −3 | −9 |
| | b* | 47 | 43 | 9 | 9 | 47 |
| Cover | Composition | R | R | N | O | K |
| | Zone | X | X | IV | V | I |
| | Color | Blue | Blue | Pink | Blue | Yellow |
| | T/NT | T | T | T | T | T |
| | L | 85 | 85 | 84 | 80 | 60 |
| | a* | −3 | −3 | 19 | 0 | −10 |
| | b* | −10 | −10 | −10 | −25 | 30 |
| | T1 (mm) | 0.23 | 0.23 | 0.23 | 0.23 | 0.23 |
| | T2 (mm) | 0.35 | 0.35 | 0.35 | 0.35 | 0.35 |
| | T1/T2 | 0.66 | 0.66 | 0.66 | 0.66 | 0.66 |
| Visibility | | B | B | A | B | A |
| Distinguishability | | B | B | B | B | B |
| Novelty | | C | C | C | C | D |

T: Transparent
NT: Non-transparent

TABLE 6

| Results of Evaluation | | | | | | |
|---|---|---|---|---|---|---|
| | | Com. Ex. 12 | Com. Ex. 13 | Ex. 15 | Ex. 16 | Com. Ex. 14 |
| Center | Color | Blue | Blue | Blue | Blue | Blue |
| | L | 38.2 | 38.2 | 38.2 | 38.2 | 38.2 |
| | a* | −13.6 | −13.6 | −13.6 | −13.6 | −13.6 |
| | b* | −10.3 | −10.3 | −10.3 | −10.3 | −10.3 |
| Mid layer | Composition | A | A | A | A | A |
| | Zone | I | I | I | I | I |

TABLE 6-continued

| Results of Evaluation | | | | | | |
|---|---|---|---|---|---|---|
| | | Com. Ex. 12 | Com. Ex. 13 | Ex. 15 | Ex. 16 | Com. Ex. 14 |
| | Color | Yellow | Yellow | Yellow | Yellow | Yellow |
| | T/NT | NT | NT | NT | NT | NT |
| | L | 93 | 93 | 93 | 93 | 93 |
| | a* | −9 | −9 | −9 | −9 | −9 |
| | b* | 47 | 47 | 47 | 47 | 47 |
| Cover | Composition | M | N | N | N | N |
| | Zone | IV | IV | IV | IV | IV |
| | Color | Pink | Pink | Pink | Pink | Pink |
| | T/NT | NT | T | T | T | T |
| | L | 95 | 84 | 84 | 84 | 84 |
| | a* | 17 | 19 | 19 | 19 | 19 |
| | b* | −15 | −10 | −10 | −10 | −10 |
| | T1 (mm) | 0.23 | 0.07 | 0.18 | 0.28 | 0.30 |
| | T2 (mm) | 0.35 | 0.35 | 0.35 | 0.35 | 0.35 |
| | T1/T2 | 0.66 | 0.20 | 0.51 | 0.80 | 0.86 |
| Visibility | | B | B | B | B | B |
| Distinguishability | | B | B | B | B | B |
| Novelty | | D | C | B | B | D |

T: Transparent
NT: Non-transparent

TABLE 7

| Results of Evaluation | | | | | | |
|---|---|---|---|---|---|---|
| | | Ex. 17 | Ex. 18 | Ex. 19 | Ex. 20 | Ex. 21 |
| Center | Color | White | White | White | White | Blue (V) |
| | L | 97.3 | 97.3 | 97.3 | 97.3 | 38.2 |
| | a* | −0.4 | −0.4 | −0.4 | −0.4 | −13.6 |
| | b* | 1.9 | 1.9 | 1.9 | 1.9 | −10.3 |
| Mid layer | Composition | B | F | D | H | J |
| | Zone | I | IV | II | V | — |
| | Color | Yellow | Pink | Orange | Blue | Color-less |
| | T/NT | T | T | T | T | T |
| | L | 60 | 84 | 73 | 80 | 100 |
| | a* | −10 | 19 | 49 | 0 | 0 |
| | b* | 30 | −10 | 81 | −25 | 0 |
| Cover | Composition | N | K | O | L | K |
| | Zone | IV | I | V | II | I |
| | Color | Pink | Yellow | Blue | Orange | Yellow |
| | T/NT | T | T | T | T | T |
| | L | 84 | 60 | 80 | 73 | 60 |
| | a* | 19 | −10 | 0 | 49 | −10 |
| | b* | −10 | 30 | −25 | 81 | 30 |
| | T1 (mm) | 0.23 | 0.23 | 0.23 | 0.23 | 0.23 |
| | T2 (mm) | 0.35 | 0.35 | 0.35 | 0.35 | 0.35 |
| | T1/T2 | 0.66 | 0.66 | 0.66 | 0.66 | 0.66 |
| Visibility | | A | A | B | B | B |
| Distinguishability | | A | A | A | A | A |
| Novelty | | A | A | A | A | A |

T: Transparent
NT: Non-transparent

TABLE 8

| Composition of Center | | |
|---|---|---|
| | Color | |
| | White | Blue |
| BR730 | 100 | 100 |
| Fin powder | 10.65 | 10.65 |
| Sanceler SR | 38 | 38 |
| White Seal | 8.5 | 5.0 |

TABLE 8-continued

| Composition of Center | Color | |
|---|---|---|
| | White | Blue |
| Barium sulfate BD | — | 8.5 |
| Titanium dioxide | 5.0 | — |
| Diphenyl disulfide | 0.5 | 0.5 |
| Dicumyl peroxide | 0.7 | 0.8 |
| Blue 5T015 (LB) | — | 0.015 |

TABLE 9

| Composition of Mid Layer | A | B | C | D | E | F |
|---|---|---|---|---|---|---|
| Himilan 1605 | 50 | 50 | 50 | 50 | 50 | 50 |
| Himilan AM7329 | 50 | 50 | 50 | 50 | 50 | 50 |
| Titanium dioxide | 2.0 | 0.05 | 2.0 | 0.05 | 0.2 | 0.05 |
| ZQ-17 | 1.0 | 1.0 | — | — | — | — |
| GPX17 | — | — | 1.0 | 1.0 | — | — |
| GPL15 | — | — | 2.0 | 2.0 | — | — |
| GPL11 | — | — | — | — | — | 1.0 |
| PE-D 06C 579 Pink | — | — | — | — | 0.33 | — |
| Zone | I | I | II | II | IV | IV |
| Color | Yellow | Yellow | Orange | Orange | Pink | Pink |
| T/NT | NT | T | NT | T | NT | T |

T: Transparent

NT: Non-transparent

TABLE 10

| Composition of Mid layer | G | H | I | J | Q |
|---|---|---|---|---|---|
| Himilan 1605 | 50 | 50 | 50 | 50 | 50 |
| Himilan AM7329 | 50 | 50 | 50 | 50 | 50 |
| titanium dioxide | — | 0.01 | 0.05 | — | 0.05 |
| PE-D 06G 177 Blue | 2.1 | 1.0 | — | — | — |
| PE-D 06G 178 Blue | 0.7 | — | — | — | — |
| Yellow FL7G | — | — | 0.5 | — | — |
| Turq. Blue G | — | — | 0.05 | — | — |
| ZQ-17 | — | — | — | — | 0.1 |
| Zone | V | V | VIII | — | IX |
| Color | Blue | Blue | Green | Colorless | Yellow |
| T/NT | NT | T | NT | T | NT |

TABLE 10-continued

| Composition of Mid layer | G | H | I | J | Q |
|---|---|---|---|---|---|

T: Transparent

NT: Non-transparent

TABLE 11

| Composition of Cover | K | L | M | N | O | P | R |
|---|---|---|---|---|---|---|---|
| Elastollan XNY88A (Clear) | 100 | 100 | 100 | 100 | 100 | 100 | 100 |
| Titanium dioxide | 0.05 | 0.05 | 0.5 | 0.05 | 0.01 | 0.05 | 0.01 |
| ZQ-17 | 1.0 | 0.5 | — | — | — | — | — |
| GPL15 | — | 1.0 | — | — | — | — | — |
| GPL11 | — | — | 1.0 | 1.0 | — | — | — |
| PE-D 06G 177 Blue | — | — | — | — | 1.0 | — | 0.1 |
| Zone | I | II | IV | IV | V | VIII | X |
| Color | Yellow | Orange | Pink | Pink | Blue | Green | Blue |
| T/NT | T | T | NT | T | T | T | T |

T: Transparent

NT: Non-transparent

As shown in Tables 1 to 7, the golf ball of each Example is evaluated highly. From the results of evaluation, advantages of the present invention are clear.

The golf ball according to the present invention can be used for playing golf on golf courses and practicing at practice ranges. The above descriptions are merely for illustrative examples, and various modifications can be made without departing from the principles of the present invention.

What is claimed is:

1. A golf ball comprising a core and a cover covering the core, wherein a surface of the cover has a large number of dimples and a land that is a portion other than the dimples, when there are assumed:

(1) an xy plane in which an x axis and a y axis indicate indexes a* and b*, respectively, in a CIELAB color system;

(2) a circle that is present on the xy plane, has a center at an origin of the xy plane, and has a radius of 15;

(3) four straight lines that are present on the xy plane and pass through the origin and whose intersection angles with adjacent straight lines are 45'; and (4) eight zones that are present on the xy plane and are located outside the circle and each of which is sandwiched between two adjacent straight lines, an xy coordinate of a hue of an outermost layer in the core excluding a colorless and transparent layer is included in any one of the eight zones, an xy coordinate of a hue of the cover is included in a zone that is different from the zone in which the hue of the outermost layer is included and that is different from a zone adjacent to the zone in which the hue of the outermost layer is included, and a ratio (T1/T2) of a thickness T1 of the cover immediately below a deepest portion of each dimple and a thickness T2 of the cover immediately below the land is equal to or greater than 0.50 but equal to or less than 0.80.

2. The golf ball according to claim 1, wherein the cover is formed from a resin composition, the resin composition includes a base resin and a pigment and/or a dye, and a total amount of the pigment and the dye is equal to or greater than 0.5 parts by weight but equal to or less than 3.0 parts by weight per 100 parts by weight of the base resin.

3. The golf ball according to claim 1, wherein the cover is formed from a resin composition, the resin composition includes a base resin and titanium dioxide, and an amount of the titanium dioxide is equal to or greater than 0.01 parts by weight but equal to or less than 0.1 parts by weight per 100 parts by weight of the base resin.

4. The golf ball according to claim 1, further comprising a clear layer covering the cover, wherein the clear layer includes a large number of polarizing particles dispersed in a matrix resin.

5. The golf ball according to claim 1, wherein a difference (T2−T1) between the thickness T2 and the thickness T1 is equal to or greater than 0.1 mm.

6. The golf ball according to claim 1, wherein the thickness T1 is equal to or greater than 0.15 mm but equal to or less than 2.0 mm.

* * * * *